US008480821B2

(12) United States Patent
Ohishi et al.

(10) Patent No.: US 8,480,821 B2
(45) Date of Patent: Jul. 9, 2013

(54) PISTON RING MATERIAL FOR INTERNAL COMBUSTION ENGINE

(75) Inventors: Katsuhiko Ohishi, Yasugi (JP); Toshihiro Uehara, Yasugi (JP); Kunichika Kubota, Yasugi (JP)

(73) Assignee: Hitachi Metals Ltd., Tokyo (JP)

( * ) Notice: Subject to any disclaimer, the term of this patent is extended or adjusted under 35 U.S.C. 154(b) by 113 days.

(21) Appl. No.: 12/934,575

(22) PCT Filed: Mar. 17, 2009

(86) PCT No.: PCT/JP2009/055186

§ 371 (c)(1),
(2), (4) Date: Sep. 24, 2010

(87) PCT Pub. No.: WO2009/119388

PCT Pub. Date: Oct. 1, 2009

(65) Prior Publication Data

US 2011/0018207 A1 Jan. 27, 2011

(30) Foreign Application Priority Data

Mar. 27, 2008 (JP) ..... 2008-082340

(51) Int. Cl.
*C22C 38/00* (2006.01)
*F16J 9/00* (2006.01)

(52) U.S. Cl.
USPC ..... 148/328; 148/333; 148/334; 148/335; 148/332; 420/87

(58) Field of Classification Search
USPC ..... 420/87; 148/328, 333, 334, 335, 148/332
See application file for complete search history.

(56) References Cited

FOREIGN PATENT DOCUMENTS

| | | | |
|---|---|---|---|
| EP | 1 063 454 | A2 | 12/2000 |
| EP | 1 143 025 | A1 | 10/2001 |
| EP | 1 741 798 | A1 | 1/2007 |
| JP | 11-279720 | | 12/1999 |
| JP | 2001-329345 | A | 11/2001 |
| JP | 2007-321199 | | 12/2007 |
| JP | 2008-50649 | A | 3/2008 |
| WO | 2005/100626 | A1 | 10/2005 |
| WO | 2007/108365 | A1 | 9/2007 |
| WO | 2008/019717 | A1 | 2/2008 |

OTHER PUBLICATIONS

Supplementary European Search Report issued in Application No. 09726091.3 dated Feb. 1, 2011.

*Primary Examiner* — Sikyin Ip
(74) *Attorney, Agent, or Firm* — Sughrue Mion, PLLC

(57) ABSTRACT

A piston ring material is provided which retains excellent mechanical properties and processability, which are required of piston ring materials, and has wearing resistance and scuffing resistance, which are sliding properties required of piston rings. The piston ring material, which is for use in internal combustion engines, contains, in terms of mass %, 0.3-0.8% carbon, 0.1-3.0% silicon, 0.1-3.0% manganese, 0.01-0.3% sulfur, 0.1-2.0% chromium, and 0.05-2.0% the sum of titanium and/or zirconium, with the remainder being iron and incidental impurities. The titanium and/or zirconium contained in the piston ring material and the sulfur contained therein satisfy the following relationship. [Ti (%)+½Zr (%)]/S (%)≦5.0 Preferably, the material may contain one or more members selected from up to 1.0% copper, less than 3.0% molybdenum, up to 1.0% aluminum, and less than 2.0% nickel, in terms of mass %.

9 Claims, 4 Drawing Sheets

PISTON RING MATERIAL FOR INTERNAL COMBUSTION ENGINE

TECHNICAL FIELD

The present invention relates to a piston ring material used in an internal combustion engine, more specifically to a piston ring material having excellent scuffing properties and wearing resistance on the sliding surface.

BACKGROUND ART

Piston rings used in internal combustion engines, particularly in car engines, have been heretofore made of cast iron, but have been replaced with so-called steel piston rings made by forming wire such as steel flat wire into a ring shape. This is because of the requirement of thinning of rings or the improvement of their mechanical strength to meet the demand of lightweight, low fuel consumption, high speed and high output of internal combustion engines. Another major cause is the advantage of a remarkably shortened production process of the ring.

The replacement with steel piston rings is underway first in top rings or oil rings in a high load region, and materials such as Si—Cr steel and martensitic stainless steel containing 11 to 17 mass % of chromium have been used. Further, piston rings prepared by subjecting such materials to chromium plating or nitridation have been used in many cases. On the other hand, since second rings play an auxiliary role for top rings and oil rings, the material may not be an expensive stainless steel and is often directly used without any surface treatment. Although steel piston rings have greater strength, and more improved anti-fatigue and wearing resistance properties than the cast iron piston rings, their poor scuffing resistance is one of the reasons why steel is difficult to be used for second rings.

To solve the problem, the applicant has proposed a piston ring material having scuffing resistance, by adding to a low alloy steel containing 0.3 to 0.8 mass % of carbon as a main component, with an appropriate amount of sulfur and calcium in combination (see Patent Document 1). In this technique, since sulfide such as MnS is contained in the steel, sulfur forms a sulfide film in situ on the friction surface due to frictional heat, and this film improves the lubricating properties. Further, the MnS in the steel serves as a stress concentration source for the base material upon cutting or grinding, and thus has an effect of reducing the cutting energy, and therefore both scuffing resistance and workability are satisfied.

PATENT DOCUMENT 1: JP-A-2001-329345

DISCLOSURE OF THE INVENTION

Problems to be Solved by the Invention

Patent Document 1 provides an excellent technique for improving self-lubricating properties of piston ring materials. However, while the formation of self-lubricating sulfide, in particular MnS, in the steel improves the scuffing resistance on the periphery of a piston ring, it is not easy to control the shape of the piston ring because such sulfide is easily extended by hot working. Also, since MnS is a soft inclusion, it has little contribution to the wearing resistance necessary for piston ring materials. Even though the scuffing resistance is improved, the advantages against cast iron rings are reduced if the sliding properties, in particular, wearing resistance, are poor.

An object of the present invention is to provide a piston ring material for an internal combustion engine having excellent wearing resistance and scuffing resistance without decreasing excellent mechanical properties and productivity of steel piston ring materials. Another object of the present invention is to provide a material most suitable particularly for a second ring and/or a piston ring without surface treatment by achieving the above properties in the field of a low alloy steel.

Means for Solving the Problems

The inventors have conducted intensive studies on components and structures which affect properties required for piston rings. As a result, they have found that a sulfide or carbosulfide of titanium or zirconium is hard and causes little shape change by hot working and it can be formed by adding sulfur to a low alloy steel containing 0.3 to 0.8% by mass of carbon as a main component and simultaneously adding titanium or zirconium which is more capable of forming sulfide than manganese. Thus, very good wearing resistance and scuffing resistance can be achieved without decreasing mechanical properties and productivity of piston rings.

Accordingly, the present invention provides a piston ring material for an internal combustion engine, comprising: % by mass: 0.3 to 0.8% of carbon (C); 0.1 to 3.0% of silicon (Si); 0.1 to 3.0% of manganese (Mn); 0.01 to 0.3% of sulfur (S); 0.1 to 2.0% of chromium (Cr); a total of 0.05 to 2.0% of titanium (Ti) and/or zirconium (Zr); and the balance being iron (Fe) and incidental impurities, wherein titanium (Ti) and/or zirconium (Zr) and sulfur (S) satisfy the relationship $[Ti(\%)+\frac{1}{2}Zr(\%)]/S(\%) \leqq 5.0$.

Preferably, the piston ring material for an internal combustion engine comprises, by mass, one or more elements of copper (Cu), molybdenum (Mo), aluminum (Al) and nickel (Ni) in a range of not more than 1.0% of copper, less than 3.0% of molybdenum, not more than 1.0% of aluminum and less than 2.0% of nickel.

Advantages of the Invention

According to the present invention, titanium and zirconium sulfides or carbosulfides have excellent self-lubricating properties. Since such sulfides or carbosulfides are formed by crystallizing from molten steel, they hardly suffer from shape change through thermal refining treatment such as quenching and tempering, avoiding the need of complicated structure control. Moreover, the above sulfide or carbosulfide is hard. Thus, the piston ring material of the present invention in which particles of such sulfide or carbosulfide are dispersed in the structure has scuffing resistance and wearing resistance along the periphery, making a great contribution to the improvement of properties of piston rings.

DESCRIPTION OF REFERENCE NUMERALS

Figure 1:
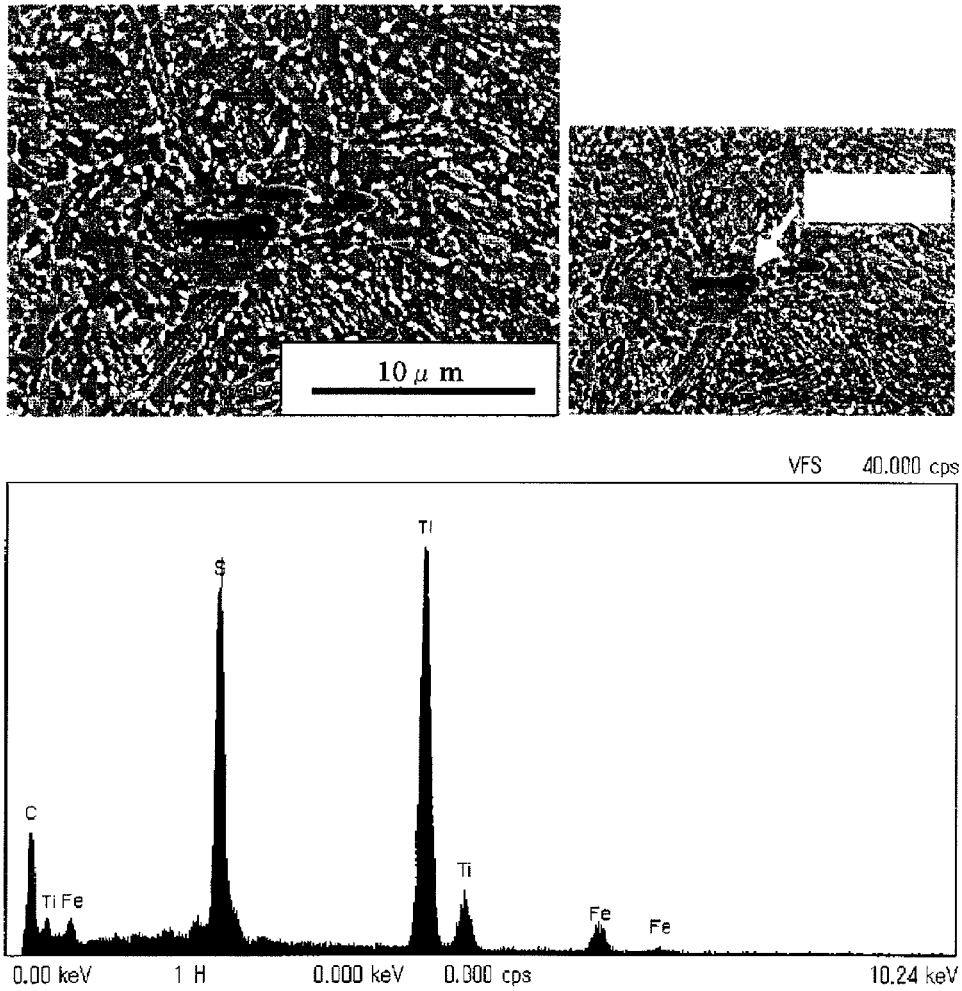
FIG. 1 is a scanning electron microscope (SEM) photograph and the result of energy dispersive X-ray fluorescence (EDX) analysis of the material No. 1 according to the invention.

1 Specimen (Φ8 mm×20 mm L)
2 Counterpart material: JIS gray iron (FC250)
3 Turbine oil (#100)
4 Counterpart material: JIS aluminum alloy casting (AC8A)

BEST MODE FOR CARRYING OUT THE INVENTION

As described above, an important feature of the present invention lies in the finding that titanium and zirconium sulfides or carbosulfides in structure have a great positive effect on the major properties of piston ring materials, i.e., wearing resistance, in particular, scuffing resistance. Accordingly, it is possible to provide a piston ring material having excellent mechanical properties and sliding properties by adding an alloy element which forms the above inclusions and by strictly controlling their content. In the following, the composition in present invention will be described in detail.

Carbon (C) is an important element in the present invention. It not only forms carbide to improve scuffing resistance and wearing resistance but also contributes to the improvement of strength and fatigue properties when a part of carbon solid-solutes in the matrix. To this end, at least 0.3% by mass (hereinafter simply referred to as %) of carbon is necessary. However, when it is more than 0.8%, processing into a flat wire or a ring becomes difficult. In particular, because it is important to improve the productivity and thus produce them at low cost for piston rings, the upper limit is 0.8%. The lower limit of carbon is preferably 0.4% and the upper limit of carbon is preferably 0.7%.

Silicon (Si) is generally added as a deoxidant and also has an impact on the temper softening behavior of steel, playing an important role particularly in a low alloy steel. To avoid temper softening and increase heat resistant strength, not less than 0.1% of silicon is necessary. However, the upper limit is 3.0%, because the excessive addition causes a decrease in cold workability. The lower limit of silicon is preferably 0.5%, more preferably 1.0%. The upper limit of silicon is preferably 2.0%, more preferably 1.5%.

Manganese (Mn) is also an essential element used as a deoxidant as silicon. Not less than 0.1% of manganese is necessary to achieve the effect, but the excessive addition causes a decrease in workability in hot working. For that reason, the upper limit of manganese is defined as 3.0%. The lower limit of manganese is preferably 0.2%, more preferably 0.5%. The upper limit of manganese is preferably 1.5%, more preferably 1.0%.

Sulfur (S) is one of the most important elements in the present invention. As described above, steel piston rings have poorer scuffing properties than cast iron piston rings, and this is one of the reasons why steel is difficult to be used for second rings. However, when sulfur is added, sulfur bonds to titanium or zirconium described later, and the formation of their sulfide or carbosulfide in the structure leads to the development of self-lubricating properties, improving the scuffing resistance. Also, sulfur is very effective for improving cutting properties. In the present invention, not less than 0.01% of sulfur is necessary to achieve these effects. However, since the excessive addition causes a deterioration in corrosion resistance or toughness and ductility in cold working as well as hot workability, the upper limit is 0.3%. The lower limit of sulfur is preferably 0.05%, more preferably 0.1%. The upper limit of sulfur is preferably 0.2%.

A part of the chromium (Cr) bonds to carbon to form carbide and thus increases the wearing resistance, while a part of the chromium solid-solutes in the matrix to improve the corrosion resistance. Also, since chromium improves temper softening resistance, it is an essential element for improving thermal permanent-set resistance of piston rings and ensuring hardenability and thus obtaining sufficient heat treatment hardness. To achieve these effects, at least 0.1% of chromium is necessary. However, the excessive addition causes a decrease in thermal conductivity and thus causes an increase in the temperature by sliding on the contact face, deteriorating scuffing resistance. Moreover, such excessive addition leads to an increase in the amount and the size of carbide, resulting in a remarkable decrease in the workability. Therefore, the upper limit is 2.0%. The lower limit of chromium is preferably 0.4%. The upper limit of chromium is preferably 1.5%, more preferably 1.0%.

Titanum (Ti) and zirconium (Zr) are the most important elements in the present invention as well as sulfur. These alloy elements bond to sulfur in molten steel and are crystallized as sulfide. Also, after stable carbide is formed at higher temperatures, a part thereof is substituted with or bonded to sulfur and crystallized as carbosulfide. Not only such sulfide and carbosulfide effectively serve as a self lubricating agent because they contain lubricative sulfur, but also they contribute to wearing resistance as carbide does because they are hard inclusions.

Further, since they are less extendable by hot working compared to MnS, the shape control is not difficult. Moreover, since sulfides of titanium and zirconium are very stable, they hardly suffer from shape change through thermal hardening treatment, and thus, structure control is easy. To achieve these effects, a total of not less than 0.05% of at least one of titanium and zirconium is necessary. On the other hand, however, when these elements are excessively added, not only the above effects become saturated, but also a large amount of oxide or nitride remain in steel, contributing to a remarkable decrease in the corrosion resistance and toughness, and also causing a decrease in the toughness and ductility. Therefore, the upper limit is 2.0%. The lower limit of titanium and/or zirconium is preferably 0.1%, more preferably 0.2% in total. The upper limit of titanium and/or zirconium is preferably 1.0%, more preferably 0.8% in total.

In the piston ring material of the present invention, each of the above titanium and zirconium may be added alone. In that case, titanium is a highly active metal and thus has a higher ability to form oxide, nitride or carbide than zirconium. Therefore, in order to stabilize the structure intended in the present invention in which sulfide or carbosulfide is formed, it is desired to select zirconium.

In the present invention, the above wearing resistance and scuffing resistance are achieved by designing an alloy for a piston ring material, more specifically, by adding sulfur, titanium and zirconium. Therefore, a most improvement feature of the present invention lies in mutually and precisely adjusting the amount of addition of these elements. The reason will be described in detail below.

Cast iron piston rings have better scuffing resistance of piston ring materials than steel piston rings. This is largely due to the crystal structure of graphite in the structure of the cast iron. More specifically, crystal of graphite has a hexagonal crystal structure in which hexagonal rings composed of carbon atoms are stacked at equal intervals. Since the c/a lattice constant ratio is larger than the theoretical value, cleavage easily occurs at the bottom to induce interlamellar cleavage fracture, developing lubricating properties. However, while lubricating properties developed by its own fracture as in the case of graphite have a beneficial effect on scuffing resistance, they have the opposite effect on wearing resistance.

On the other hand, lubricating properties of the piston ring material of the present invention are developed by forming titanium and zirconium sulfide (carbosulfide) in the structure. The mechanism of this action is assumed that the above sulfide (carbosulfide) forms a deposit between the piston ring material and the counterpart material upon sliding to develop lubricating properties. It is thought that these inclusions have the effect of suppressing mechanical wear or diffusion wear in addition to the above lubricating function. Thus, they are also effective for wearing resistance.

Titanium and zirconium sulfide or carbosulfide produces the above effect and is greatly influenced mainly by the content of sulfur, titanium and zirconium constituting the sulfide or carbosulfide. Therefore, it is important to control the content of the three elements to an appropriate range in the low alloy steel containing the content of carbon and chromium according to the present invention. Herein, zirconium has an atomic weight about twice that of titanium since titanium and zirconium belonging to the same group 4 in the periodic table. Therefore, the level of the advantageous effects can be simply evaluated based in terms of titanium equivalent on the relationship of $$Ti=2Zr.$$

From the above, the optimal content of the above three elements according to the present invention can be mutually controlled based on the following formula.

In the piston ring material of the present invention, it is necessary to adjust the ratio of the content of titanium and/or zirconium to the content of sulfur in the steel so as to satisfy the relationship $$[Ti\ (\%)+\tfrac{1}{2}Zr\ (\%)]/S\ (\%)\leqq 5.0.$$

When the value is larger than 5.0, it becomes difficult to form the above sulfide or carbosulfide. Since carbide constitutes a large portion, it becomes difficult to maintain the scuffing resistance. The value is preferably not more than 4.5, more preferably not more than 3.0. The lower limit of the value is not particularly defined as long as the aforementioned range of the addition of sulfur and titanium and/or zirconium is satisfied. However, in consideration of the adverse effect caused by excess sulfur, the value is preferably not less than 1.0.

As described above, by appropriately adjusting the amounts of addition of sulfur, titanium and zirconium so that the above-described formula is satisfied as well as adjusting those of the basic elements constituting the low alloy steel according to the present invention, a piston ring material having both wearing resistance and scuffing resistance can be obtained without decreasing other properties of a steel piston ring.

The following copper, molybdenum, aluminum and nickel may be added to the piston ring material of the present invention alone or in combination.

Copper (Cu) is an element which improves toughness in cold working and also corrosion resistance. Not less than 0.1% of copper is preferably added to achieve the effect, but the excessive addition not only causes an increase in the amount of residual austenitic phase and a decrease in temper hardness, but also reduces hot workability. Therefore, the upper limit is 1.0% when added. The lower limit of copper is preferably 0.2% and the upper limit of Cu is preferably 0.6%

Molibdenum (Mo) not only contributes to the improvement of strength as a solid solution strengthening element but also bonds to carbon to form carbide during tempering, making a contribution to the improvement of wearing resistance. Also, since molibdenum serves as a secondary hardening element on tempering, it is effective for improving thermal permanent set resistance. However, since the excessive addition causes a decrease in toughness and ductility, the upper limit is less than 3.0% when added. The lower limit of molibdenum is preferably more than 0.01% and the upper limit of molibdenum is preferably 1.5%.

Aluminum (Al) is an effective deoxidizing element as silicon and manganese. Also, aluminum has the effect of increasing nitriding hardness when surface treatment is performed. To achieve the effect, preferably not less than 0.1%, more preferably not less than 0.2%, of aluminum is added. However, since the excessive addition causes a remarkable decrease in toughness and ductility due to the formation of AlN, the upper limit is 1.0% when added. The upper limit of aluminum is preferably 0.5%.

Nickel (Ni) may be added to improve toughness when the material is used as a piston ring and receives an impact stress. However, since the excessive addition causes a remarkable decrease in workability in annealing, the upper limit is less than 2.0% when added. The upper limit is preferably 1.0% or less. The above effect of nickel is achieved when 0.05% or more of nickel is contained. To sufficiently achieve the effect, preferably 0.2% or more, more preferably 0.5% or more of nickel is added.

Since phosphor (P) is an impurity, it is preferably as low as possible. However, it is necessary to use selected expensive raw materials to reduce the content to the extreme, and also melting and refining involve high cost. In the present invention, phosphor may be contained in the range of $P\leqq 0.1\%$ as long as there is no special large problem with properties and production.

The piston ring prepared according to the present invention shows the advantage of the present invention even without surface treatment on the surface, for example, sliding surface. However, when higher scuffing resistance and wearing resistance are required, surface treatment with titanium nitride or chromium nitride through nitriding, chromium plating or PVD (physical vapor deposition) may be employed.

EXAMPLES

Ingots of 10 kg having pre-determined compositions were prepared by melting in a vacuum induction melting furnace. Table 1 shows the chemical compositions of the materials Nos. 1 to 9 according to the invention and comparative materials Nos. 11 to 14. For those to which titanium, zirconium was added, the ratios of titanium, zirconium to sulfur are also shown.

TABLE 1

| No. | C | Si | Mn | P | S | Ni | Cr | Mo | Cu | Al | Ti | Zr | Fe | (Ti + 1/2Zr)/S | mass (%) Remarks |
|---|---|---|---|---|---|---|---|---|---|---|---|---|---|---|---|
| 1 | 0.61 | 0.01 | 0.80 | 0.008 | 0.08 | 0.60 | 0.65 | 0.01 | 0.38 | 0.36 | 0.20 | — | Bal. | 2.6 | Present |
| 2 | 0.57 | 0.02 | 0.81 | 0.008 | 0.07 | 0.60 | 0.65 | 0.01 | 0.38 | 0.35 | — | 0.19 | Bal. | 2.7 | invention |
| 3 | 0.58 | 1.41 | 0.81 | 0.010 | 0.07 | 0.61 | 0.66 | 0.01 | 0.39 | 0.37 | 0.25 | — | Bal. | 3.6 | |
| 4 | 0.61 | 1.42 | 0.80 | 0.009 | 0.15 | 0.61 | 0.67 | 0.01 | 0.39 | 0.35 | 0.44 | — | Bal. | 2.9 | |
| 5 | 0.61 | 1.43 | 0.85 | 0.008 | 0.10 | 0.61 | 0.66 | 0.01 | 0.39 | 0.41 | 0.20 | 0.44 | Bal. | 4.1 | |
| 6 | 0.61 | 1.44 | 0.81 | 0.008 | 0.15 | 0.61 | 0.66 | 0.01 | 0.39 | 0.41 | 0.40 | 0.43 | Bal. | 4.0 | |
| 7 | 0.61 | 1.46 | 0.74 | 0.009 | 0.12 | 0.61 | 0.65 | 0.01 | 0.40 | 0.42 | 0.20 | 0.71 | Bal. | 4.6 | |
| 8 | 0.60 | 1.38 | 0.85 | 0.008 | 0.15 | 0.60 | 0.65 | 0.01 | 0.38 | 0.41 | — | 0.42 | Bal. | 1.4 | |
| 9 | 0.60 | 1.36 | 0.78 | 0.006 | 0.15 | 0.61 | 0.66 | 0.02 | 0.39 | 0.39 | 0.40 | — | Bal. | 2.7 | |
| 11 | 0.54 | 1.41 | 0.81 | 0.006 | 0.07 | 0.60 | 0.66 | 0.02 | 0.38 | 0.33 | — | — | Bal. | — | Comparative |
| 12 | 0.58 | 1.44 | 0.80 | 0.007 | 0.08 | 0.61 | 0.65 | 0.02 | 0.01 | 0.36 | — | — | Bal. | — | example |
| 13 | 0.60 | 0.02 | 0.82 | 0.006 | 0.08 | 0.59 | 0.65 | 0.01 | 0.38 | 0.38 | 0.42 | — | Bal. | 5.1 | |
| 14 | 0.60 | 1.43 | 0.80 | 0.009 | 0.04 | 0.61 | 0.66 | 0.01 | 0.39 | 0.35 | 0.20 | 0.39 | Bal. | 9.5 | |

Next, the ingots were hot worked to form a 15 mm square bar materials and the materials were annealed. A part of the resulting annealed materials were processed into a shape of specimens for a tensile test having a length of the parallel portion of 45 mm and a diameter of the parallel portion of 7 mm. The specimens were subjected to a tensile test for evaluating drawing workability and rolling workability of a wire. The results are shown in Table 2. Table 2 proves that the materials according to the invention have a reduction of area after annealing of about not less than 40%, showing good cold workability. Even though a part of the specimens has a reduction of area of 40% or less, it has workability sufficient for cold working and has no problem of production.

TABLE 2

| No. | Tensile strength ($N/mm^2$) | Elongation (%) | Reduction of area (%) | Hardness (HV) | Remarks |
|---|---|---|---|---|---|
| 1 | 751 | 21 | 47 | 216 | Present |
| 2 | 745 | 24 | 49 | 210 | invention |
| 3 | 1082 | 18 | 54 | 294 | |
| 4 | 1098 | 17 | 48 | 305 | |
| 5 | 1124 | 15 | 44 | 315 | |
| 6 | 1068 | 16 | 43 | 305 | |
| 7 | 1063 | 17 | 46 | 325 | |
| 8 | 860 | 18 | 36 | 239 | |
| 9 | 775 | 22 | 50 | 220 | |
| 11 | 887 | 21 | 52 | 236 | Comparative |
| 12 | 735 | 26 | 54 | 210 | example |
| 13 | 763 | 24 | 52 | 214 | |
| 14 | 1099 | 15 | 47 | 298 | |

Figure 2:
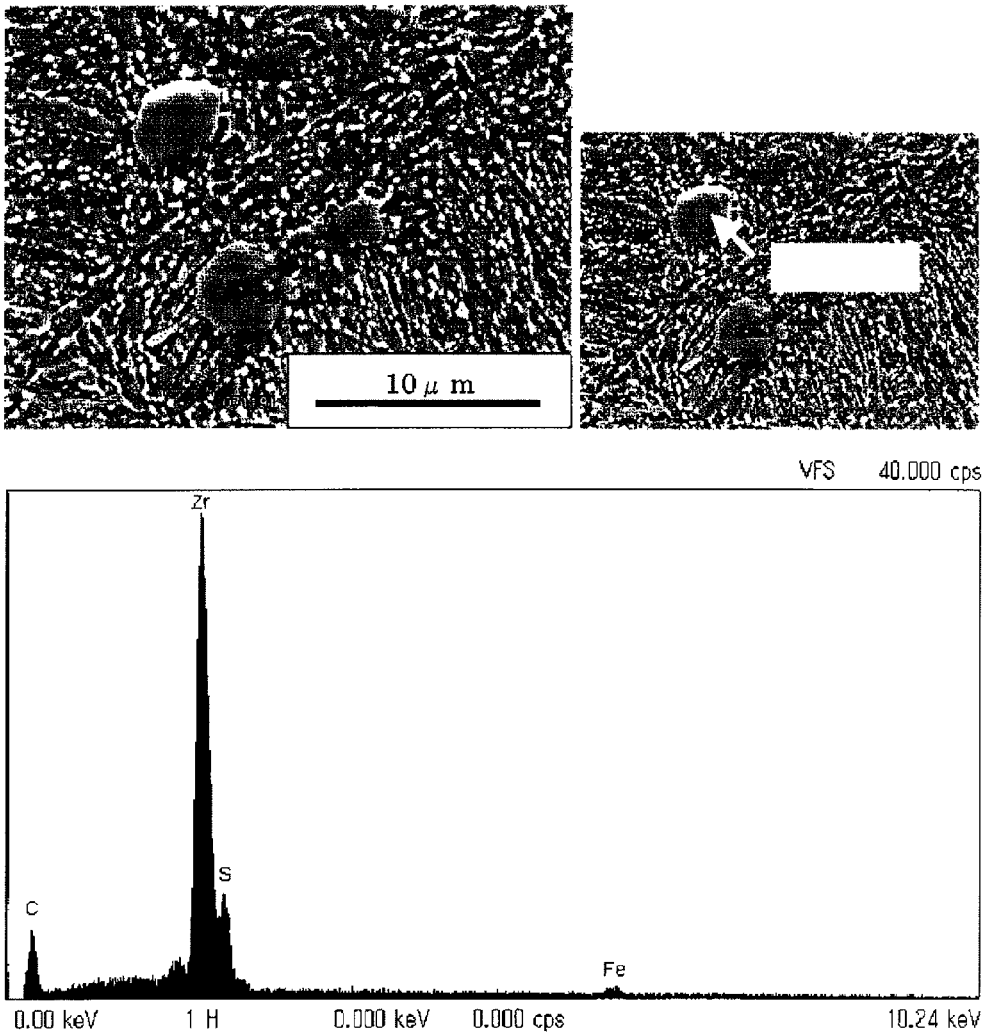
FIG. 2 is a SEM photograph and the result of EDX analysis of the material No. 2 according to the invention.

Subsequently, the remaining annealed materials were quenched from 1050° C. and then tempered to a hardness of 40 or 50 HRC. FIGS. 1 and 2 show SEM observation and the result of EDX analysis of the materials Nos. 1 and 2 of the heat treated materials according to the invention. It is confirmed that carbosulfide of titanium or zirconium was formed in the structures of the inventive materials.

Then, columnar specimens of ϕ8 mm×20 mm length and a rectangular specimens of 5 mm square and 10 mm length were prepared from the heat treated materials, and they were subjected to a wearing resistance test and a scuffing resistance test for evaluating wearing resistance and scuffing resistance which are sliding properties of piston rings under the following conditions.

Figure 3:
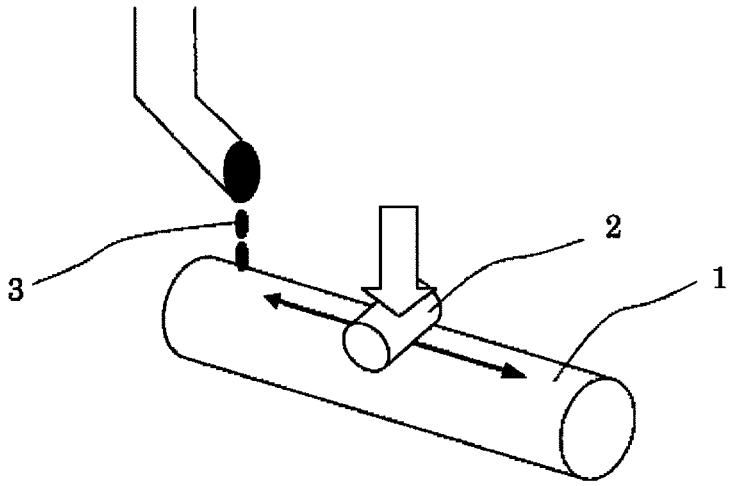
FIG. 3 is a schematic view illustrating a method of a reciprocating friction and wear test used in Examples.

The wearing resistance test was performed using a reciprocating friction and wear tester under the following conditions, and the specimens were evaluated based on the wear width. FIG. 3 shows a schematic view of the reciprocating friction and wear test (Specimen 1, Counterpart material 2, and Turbine oil 3).

Load: 490 N

Rate: 0.25 m/s

Counterpart material: JIS gray iron (FC250)

Number of sliding cycles: 500 times

Lubricating oil: turbine oil #100

(lubrication: room temperature)

Hardness of specimen: 40 HRC

Figure 4:
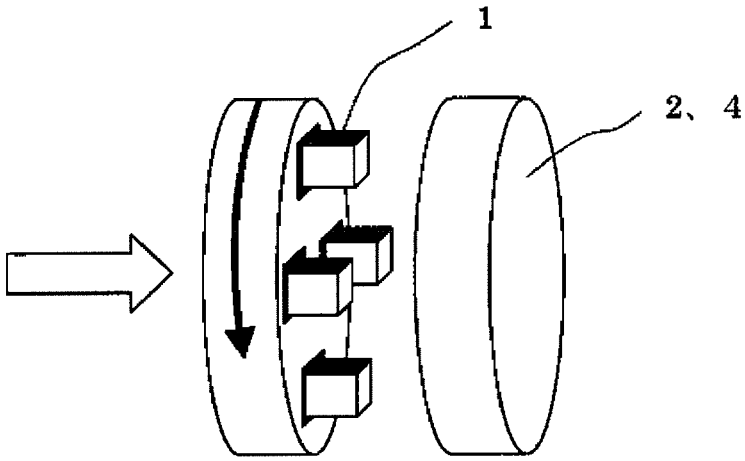
FIG. 4 is a schematic view illustrating a method of a high pressure friction and wear test used in Examples.

The scuffing resistance test was performed using a high pressure friction and wear tester under the following conditions, and the specimens were evaluated based on the seizure load. FIG. 4 shows a schematic view of the high pressure friction and wear test (Specimen 1, Counterpart material 2 or 4).

Friction rate: 2 m/s

Pressure on friction surface: initial 15 $kgf/cm^2$, increased by 5 $kgf/cm^2$ per minute Lubricating oil: turbine oil #100 (lubrication: room temperature), for only first 1 minute Counterpart material: JIS gray iron (FC250), JIS aluminum alloy casting (AC8A)

Hardness of specimen: 40 HRC (counterpart material: FC250), 50 HRC (counterpart material: AC8A)

Figure 5:
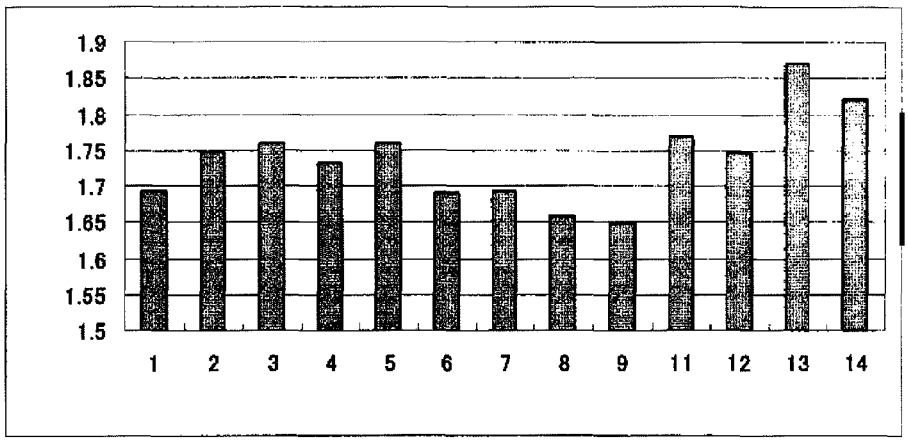
FIG. 5 is a view illustrating the results of the reciprocating friction and wear test of the materials according to the invention and the comparative materials.

FIG. 5 shows the results of the evaluation of wearing resistance based on the reciprocating friction and wear test. The results show that the materials according to the invention, to which titanium and/or zirconium was added have a smaller wear width than the comparative materials and thus have excellent wearing resistance as piston ring materials. Despite the addition of titanium and/or zirconium, the comparative materials No. 13, 14 have a large amount of wear since the values (Ti+½Zr)/S are high.

Figure 6:
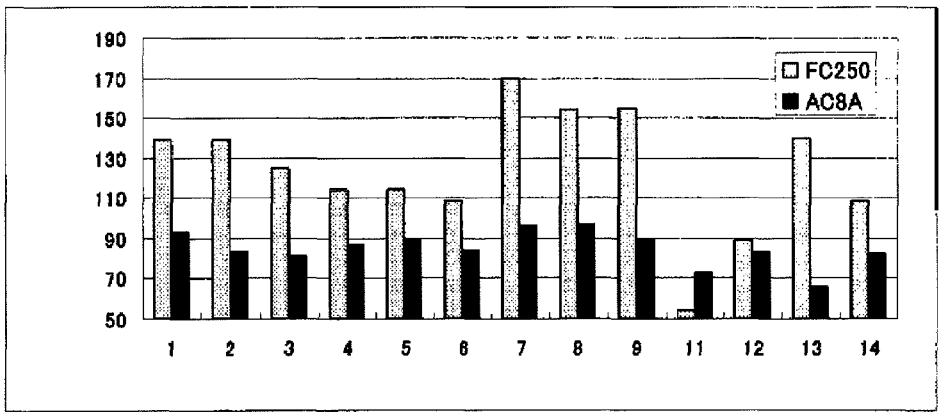
FIG. 6 is a view illustrating the results of the high pressure friction and wear test of the materials according to the invention and the comparative materials.

FIG. 6 shows the results of the evaluation of scuffing resistance based on the high pressure friction and wear test. The materials according to the invention, to which titanium or zirconium was added, have a large scuff surface pressure for both counterpart materials of AC8A designed for a piston material and FC250 designed for a cylinder liner material. It proves that the materials have excellent anti-scuffing properties. The comparative material No. 13 to which titanium was added and which has a high titanium/sulfur value has an excellent scuffing resistance against FC250, but a remarkably reduced scuffing resistance against AC8A. It is highly likely that the comparative material No. 13 adheres to a piston upon contact when actually used as a piston ring.

The invention claimed is:

1. A piston ring material for an internal combustion engine, comprising: by mass, 0.3 to 0.8% of carbon;

0.01 to 3.0% of silicon;

0.1 to 3.0% of manganese;

0.01 to 0.3% of sulfur;

0.1 to 2.0% of chromium;

0.19% to 2.0% of zirconium;

optionally titanium, wherein a total of zirconium and titanium is 0.19% to 2.0% when titanium is present; and the balance being iron and incidental impurities, wherein zirconium (Zr), titanium (Ti) and sulfur (S) satisfy the relationship: $[Ti(\%)+\frac{1}{2}Zr(\%)]/S(\%) \leqq 5.0$, wherein a structure of the material contains a sulfide or carbosulfide of zirconium and, when titanium is present, a sulfide or carbosulfide of titanium.

2. The piston ring material according to claim 1, further comprising not more than 1.0% by mass of copper.

3. The piston ring material according to claim 1, further comprising less than 3.0% by mass of molybdenum.

4. The piston ring material according to claim 1, further comprising not more than 1.0% by mass of aluminum.

5. The piston ring material according to claim 1, further comprising less than 2.0% by mass of nickel.

6. The piston ring material according to claim 1, further comprising two or more elements of copper, molybdenum, aluminum and nickel, in the range of, by mass, not more than 1.0% of copper, less than 3.0% of molybdenum, not more than 1.0% of aluminum and less than 2.0% of nickel.

7. The piston ring material according to claim 1, further comprising 0.1 to 1.0% by mass of copper.

8. The piston ring material according to claim 1, further comprising 0.1 to 1.0% by mass of aluminum.

9. The piston ring material according to claim 1, further comprising two or more elements of copper, molybdenum, aluminum and nickel, in the range of, by mass, 0.1 to 1.0% of copper, less than 3.0% of molybdenum, 0.1 to 1.0% of aluminum and less than 2.0% of nickel.

* * * * *